US010132148B2

(12) United States Patent
Moore et al.

(10) Patent No.: US 10,132,148 B2
(45) Date of Patent: Nov. 20, 2018

(54) METHODS AND APPARATUS FOR DOWNHOLE PROPELLANT-BASED STIMULATION WITH WELLBORE PRESSURE CONTAINMENT

(71) Applicant: Orbital ATK, Inc., Dulles, VA (US)

(72) Inventors: Steven E. Moore, Elkton, MD (US); John A. Arrell, Jr., Lincoln University, PA (US)

(73) Assignee: Orbital ATK, Inc., Plymouth, MN (US)

( * ) Notice: Subject to any disclaimer, the term of this patent is extended or adjusted under 35 U.S.C. 154(b) by 843 days.

(21) Appl. No.: 14/491,246

(22) Filed: Sep. 19, 2014

(65) Prior Publication Data

US 2016/0084059 A1 Mar. 24, 2016

(51) Int. Cl.

| | |
|---|---|
| ***E21B 43/26*** | (2006.01) |
| ***E21B 43/263*** | (2006.01) |
| ***C06B 45/00*** | (2006.01) |
| ***F42B 1/00*** | (2006.01) |
| ***F42B 1/04*** | (2006.01) |
| ***E21B 33/124*** | (2006.01) |
| ***E21B 43/247*** | (2006.01) |
| ***C06B 45/10*** | (2006.01) |

(52) U.S. Cl.

CPC ..... *E21B 43/263* (2013.01); *C06B 45/00* (2013.01); *C06B 45/10* (2013.01); *C06B 45/105* (2013.01); *E21B 33/124* (2013.01); *E21B 43/247* (2013.01); *F42B 1/00* (2013.01); *F42B 1/04* (2013.01)

(58) Field of Classification Search

CPC ..... E21B 23/06; E21B 23/065; E21B 33/124; E21B 43/263; E21B 43/247; F42B 1/00; F42B 1/04; C06B 45/00; C06B 45/10; C06B 45/105; C06B 33/00; C06B 25/00; C06B 29/00; C06B 31/00

See application file for complete search history.

(56) References Cited

U.S. PATENT DOCUMENTS

| | | |
|---|---|---|
| 2,921,519 A | 1/1960 | Martin |
| 3,090,436 A | 5/1963 | Briggs, Jr. |

(Continued)

OTHER PUBLICATIONS

Schatz, John, "PulsFrac™ Summary Technical Description," John F. Schatz Research & Consulting, Inc., Del Mar, CA, (2003), pp. 1-8.

(Continued)

*Primary Examiner* — Robert Edward Fuller
*Assistant Examiner* — Christopher J Sebesta
(74) *Attorney, Agent, or Firm* — TraskBritt

(57) ABSTRACT

Downhole stimulation tools include a housing and at least one propellant structure within the housing comprising at least one propellant grain of a formulation, at least another propellant grain of a formulation different from the formulation of the at least one propellant grain longitudinally adjacent the at least one propellant grain, and at least one initiation element proximate at least one of the propellant grains. At least one pressure containment structure is secured to the housing and comprises a seal element expandable in response to gas pressure generated by combustion of a propellant grain of the at least one propellant structure. Related methods are also disclosed.

21 Claims, 3 Drawing Sheets

(56) References Cited

U.S. PATENT DOCUMENTS

| | | | | |
|---|---|---|---|---|
| 3,266,575 | A * | 8/1966 | Owen | E21B 23/065 166/120 |
| 3,422,760 | A | 1/1969 | Mohaupt | |
| 3,602,304 | A * | 8/1971 | Mallinger | E21B 43/263 166/63 |
| 3,677,010 | A | 7/1972 | Fink et al. | |
| 4,253,523 | A | 3/1981 | Ibsen | |
| 4,391,337 | A | 7/1983 | Ford et al. | |
| 4,633,951 | A | 1/1987 | Hill et al. | |
| 4,729,317 | A | 3/1988 | Burdette et al. | |
| 4,798,244 | A | 1/1989 | Trost | |
| 4,823,875 | A * | 4/1989 | Hill | E21B 43/267 166/280.1 |
| 4,840,231 | A * | 6/1989 | Berzin | E21B 33/1275 166/181 |
| 5,230,287 | A | 7/1993 | Arrell, Jr. et al. | |
| 5,431,101 | A | 7/1995 | Arrell, Jr. et al. | |
| 5,626,360 | A | 5/1997 | Lauritzen et al. | |
| 6,055,213 | A * | 4/2000 | Rubbo | E21B 41/00 175/40 |
| 6,082,450 | A | 7/2000 | Snider et al. | |
| 6,263,283 | B1 | 7/2001 | Snider et al. | |
| 6,817,298 | B1 | 11/2004 | Zharkov et al. | |
| 7,073,589 | B2 | 7/2006 | Tiernan et al. | |
| 7,097,203 | B2 | 8/2006 | Burns et al. | |
| 7,353,866 | B2 | 4/2008 | Snider et al. | |
| 7,431,075 | B2 | 10/2008 | Brooks et al. | |
| 7,487,827 | B2 | 2/2009 | Tiernan | |
| 7,565,930 | B2 | 7/2009 | Seekford | |
| 7,789,153 | B2 | 9/2010 | Prinz et al. | |
| 7,810,569 | B2 | 10/2010 | Hill et al. | |
| 7,861,785 | B2 | 1/2011 | Frazier et al. | |
| 7,909,096 | B2 | 3/2011 | Clark et al. | |
| 7,950,457 | B2 | 5/2011 | Seekford | |
| 8,033,333 | B2 | 10/2011 | Frazier et al. | |
| 8,186,425 | B2 | 5/2012 | Smart et al. | |
| 8,186,435 | B2 | 5/2012 | Seekford | |
| 2003/0155112 | A1 | 8/2003 | Tiernan et al. | |
| 2005/0109509 | A1 | 5/2005 | Snider et al. | |
| 2006/0048664 | A1 | 3/2006 | Tiernan et al. | |
| 2008/0099204 | A1 | 5/2008 | Arrell | |
| 2008/0314591 | A1* | 12/2008 | Hales | E21B 33/12 166/285 |
| 2009/0078427 | A1* | 3/2009 | Patel | E21B 43/10 166/372 |
| 2009/0159285 | A1* | 6/2009 | Goodman | F42C 15/42 166/297 |
| 2009/0301721 | A1 | 12/2009 | Barykin | |
| 2012/0138302 | A1 | 6/2012 | Stehle | |
| 2012/0150515 | A1* | 6/2012 | Hariharan | E21B 33/124 703/7 |
| 2014/0238678 | A1 | 8/2014 | Arrell, Jr. et al. | |
| 2015/0267501 | A1* | 9/2015 | Al-Gouhi | E21B 23/065 166/299 |
| 2015/0275643 | A1 | 10/2015 | Holder et al. | |

OTHER PUBLICATIONS

Thakre et al., "Solid Propellants," Rocket Propulsion, vol. 2, Encyclopedia of Aerospace Engineering, John Wiley & Sons, LTD., (2010), pp. 1-10.

International Search Report, ISA/KR, International Application No. PCT/US2014/017064, Jun. 23, 2014, three (3) pages.

Written Opinion of the International Searching Authority, ISA/KR, International Application No. PCT/US2014/017064, Jun. 23, 2014, 12 pages.

* cited by examiner

METHODS AND APPARATUS FOR DOWNHOLE PROPELLANT-BASED STIMULATION WITH WELLBORE PRESSURE CONTAINMENT

CROSS-REFERENCE TO RELATED APPLICATIONS

This application is related to U.S. patent application Ser. No. 14/491,518, entitled DOWNHOLE STIMULATION TOOLS AND RELATED METHODS OF STIMULATING A PRODUCING FORMATION, filed Sep. 9, 2014, now U.S. Pat. No. 9,995,124, issued Jun. 12, 2018, the disclosure of which is hereby incorporated herein in its entirety by this reference. This application is also related to U.S. patent application Ser. No. 13/781,217 filed on Feb. 28, 2013, now U.S. Pat. 9, 447,672, issued Sep. 20, 2016, the disclosure of which is hereby incorporated herein in its entirety by this reference.

TECHNICAL FIELD

Embodiments of the present disclosure relate to the use of propellants to generate elevated pressures in wellbores. More particularly, embodiments of the present disclosure relate to methods and apparatus for propellant-based stimulation of one or more producing formations intersected by a wellbore with physical containment of elevated pressure in a wellbore interval adjacent the one or more producing formations associated with such propellant-based stimulation.

BACKGROUND

Conventional propellant-based downhole stimulation employs only one ballistic option, in the form of a right circular cylinder of a single type of propellant grain, which may comprise a single volume or a plurality of propellant "sticks" in a housing and typically having an axially extending hole through the center of the propellant through which a detonation cord extends, although it has been known to wrap the detonation cord helically around the propellant grain. When deployed in a wellbore adjacent a producing formation, the detonation cord is initiated and gases from the burning propellant grain exit the housing at select locations, entering the producing formation. The pressurized gas may be employed to fracture a formation, to perforate the formation when spatially directed through apertures in the housing against the wellbore wall, or to clean existing fractures or perforations made by other techniques, in any of the foregoing cases increasing the effective surface area of producing formation material available for production of hydrocarbons or geothermal energy. In conventional propellant-based stimulation, due to the use of a single, homogeneous propellant and centalized propellant initiation, only a single ballistic trace in the form of a gas pressure pulse from propellant burn may be produced.

U.S. Pat. Nos. 7,565,930, 7,950,457 and 8,186,435 to Seekford et al., the disclosure of each of which is incorporated herein in its entirety by this reference, propose a technique to alter an initial surface area for propellant burning, but this technique cannot provide a full regime of potentially available and desirable ballistics (i.e., various solutions associated with pressure versus time possibilities resulting from propellant burn) for propellant-induced stimulation in a downhole environment. It would be desirable to provide enhanced control of not only the initial surface area (which alters the initial rise rate of the gas pulse, or dP/dt, responsive to propellant ignition), but also the duration and shape of the remainder of the pressure pulse introduced by the burning propellant.

U.S. patent application Ser. No. 13/781,217 by the inventors herein, filed Feb. 28, 2013, now U.S. Pat. No. 9,447,672, issued Sep. 20, 2016, assigned to the Assignee of the present disclosure and the disclosure of which has been previously incorporated herein by reference, addresses the issues noted above and left untouched by Seekford et al.

It is known to provide downhole structures configured for containing, at least in part, wellbore pressures elevated above hydrostatic for stimulation purposes. For example, U.S. Pat. No. 3,090,436 describes the use of opposing, cup-shaped packer members in a bottomhole assembly for containing pressurized fracturing fluid used for fracturing a formation intersected by a wellbore, the packer cups expanding. U.S. Pat. No. 3,602,304 describes the use of a propellant charge to set an anchor and packer above a propellant container housing propellant charges for fracturing. U.S. Pat. No. 7,487,827 describes the use of so-called "restrictor plugs" carried by a stimulation tool, which restrictor plugs project radially from a stimulation tool to restrict, but not prevent, flow of combustion gases generated by a propellant charge between the restrictor plugs and wellbore casing. U.S. Pat. No. 7,810,569 describes the use of expandable, high-pressure seals for containing elevated pressure used for fracturing a formation. U.S. Pat. No. 7,909,096 describes the use of packers and packer/bridge plug combinations for isolating pressure of a fluid used for stimulation. The disclosure of each of the foregoing patents listed in this paragraph is hereby incorporated herein in its entirety by reference.

The inventors herein have developed further enhancements to the methods and apparatus described in the '217 application, as described in U.S. patent application Ser. No. 14/491,518, filed Sep. 19, 2014, now U.S. Pat. No. 9,995,124, issued Jun. 12, 2018, the disclosure of which has also been previously incorporated herein by reference, as well as to the methods and apparatus described in the preceding paragraph. More specifically and with regard to the present disclosure, the inventors herein have developed apparatus incorporated into stimulations tools, and related methods, to enable more effective use of propellant-based stimulation tools producing relatively high, variable and extended duration pressure pulses, including, but not limited to, those described in U.S. patent application Ser. No. 13/781,217, filed Feb. 28, 2013, now U.S. Pat. No. 9,447,672, issued Sep. 20, 2016, and U.S. patent application Ser. No. 14/491,518, filed Sep. 19, 2014, now U.S. Pat. No. 9,995,124, issued Jun. 12, 2018.

BRIEF SUMMARY

In some embodiments, the present disclosure comprises a downhole stimulation tool, comprising a housing and at least one propellant structure within the housing, the propellant structure comprising at least one propellant grain of a formulation, at least another propellant grain of a formulation different from the formulation of the at least one propellant grain longitudinally adjacent the at least one propellant grain and at least one initiation element proximate at least one of the propellant grains. The downhole tool further comprises at least one pressure containment structure secured to the housing and comprising a seal element expandable in response to gas pressure generated by combustion of a propellant grain of the at least one propellant structure.

In other embodiments, the present disclosure comprises a method of operating a downhole stimulation tool, the method comprising deploying the downhole stimulation tool within a wellbore adjacent a producing formation, initiating at least one propellant grain of a formulation from a face of the at least one propellant grain to burn the at least one propellant grain in a longitudinally extending direction and generate gas pressure for stimulating the producing formation, transmitting a portion of the gas pressure generated within the downhole stimulation tool to expand at least one seal element of at least one pressure containment structure secured to the downhole stimulation tool and elevating pressure within the wellbore to stimulate the producing formation with a remaining portion of the generated gas pressure.

DETAILED DESCRIPTION

The illustrations presented herein are not actual views of any particular stimulation tool, or propellant structure or pressure containment structure suitable for use with a propellant-based stimulation tool, but are merely idealized representations that are employed to describe embodiments of the present disclosure.

As used herein, the term "propellant structure" means and includes the type, configuration and volume of one or more propellant grains, the type and location of one or more initiation elements and initiators and any associated components for timing of propellant grain initiation, delay of propellant grain initiation, or combinations of any of the foregoing.

As used herein, the term "extended duration," as applied with reference to an elevated pressure pulse, which may also be characterized as a ballistic trace, generated by a propellant-based stimulation tool disposed in a wellbore, includes a duration of at least about one second or more. In various embodiments, a ballistic trace may exhibit a duration of, for example and not by way of limitation, of up to sixty seconds, up to 120 seconds, up to 180 seconds, or longer.

As used herein, the term "physical containment" as applied with reference to containment of an elevated pressure pulse within a wellbore interval, means and includes physical structure in the form of for example, one or more so-called "packers" or other pressure containment structures positioned and configured to laterally (i.e., radially expand) and physically seal the wellbore interval and contain the elevated pressure pulse therein without any substantial displacement of wellbore fluid above or below (if applicable) the sealed interval or any substantial leakage of wellbore fluid from the sealed interval.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

Figure 1:
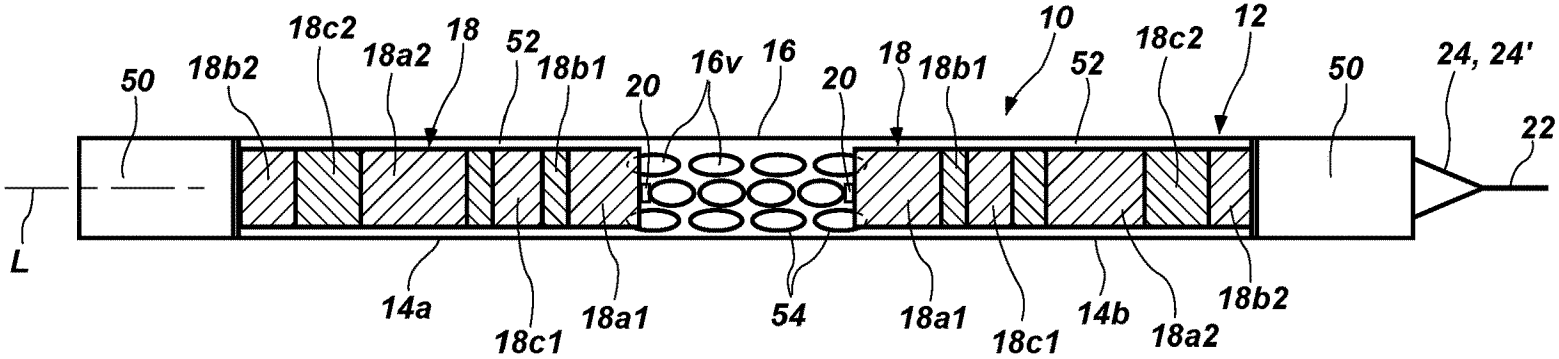
FIG. 1 is a schematic illustration of an embodiment of a propellant-based stimulation tool with which methods and apparatus of embodiments of the present disclosure may be employed.

FIG. 1 schematically depicts an example stimulation tool 10 configured with pressure containment structures according to embodiments of the disclosure, in stimulating a producing formation in a wellbore with an extended duration pressure pulse. As used herein, "producing formation" means and includes, without limitation, any target subterranean formation having the potential for producing hydrocarbons in the form of oil, natural gas, or both, as well as any subterranean formation suitable for use in geothermal heating, cooling and power generation.

Example stimulation tool 10 comprises a substantially tubular housing 12 including propellant housing segments 14*a* and 14*b*, and a center vent section 16 having a number of vent apertures 16*v* around a circumference thereof. Propellant housing segments 14*a* and 14*b* may be structured for repeated use and detachably secured to center vent segment 16, which may be structured for replacement after a single use of stimulation tool 10. Each propellant housing segment 14*a* and 14*b* contains a multi-component propellant grain 18, comprising at least two different component propellant grains, for example, three mutually different component propellant grains 18*a*, 18*b* and 18*c*.

The component propellant grains 18*a*, 18*b* and 18*c* of each multi-component propellant grain 18 are longitudinally arranged in mirror-image fashion with respect to center vent section 16, so that (for example) component propellant grain 18*a*1 within propellant housing segment 14*a* and component propellant grain 18*a*1 within propellant housing segment 14*b* are each disposed immediately adjacent to center vent section 16 and are the same propellant, of substantially equal mass, of substantially equal transverse cross-sectional diameter perpendicular to longitudinal axis L of stimulation tool 10, and of substantially equal length, taken along longitudinal axis L. Similarly, component propellant grain 18*b*1 within propellant housing segment 14*a* and component propellant grain 18*b*1 within propellant housing segment 14*b* are each disposed immediately longitudinally outward from component propellant grains 18*a*1 within the respective housing segments 14*a* and 14*b*, and are the same propellant, of substantially equal mass, of substantially equal transverse cross-sectional diameter perpendicular to longitudinal axis L of stimulation tool 10, and of substantially equal length, taken along longitudinal axis L. Likewise component propellant grain 18*c*1 within propellant housing segment 14*a* and component propellant grain 18*c*1 within propellant housing segment 14*b* are each disposed immediately longitudinally outward from component propellant grains 18*b*1 within the respective housing segments 14*a* and 14*b*, and are the same propellant, of substantially equal mass, of substantially equal transverse cross-sectional diameter perpendicular to longitudinal axis L of stimulation tool 10, and of substantially equal length, taken along longitudinal axis L. Continuing with a description of FIG. 1, component propellant grain 18*a*2 within propellant housing segment 14*a* and component propellant grain 18*a*2 within propellant housing segment 14*b* are each disposed immediately longitudinally outward from component propellant grains 18*c*1 within the respective housing segments 14*a* and 14*b*, and are the same propellant, of substantially equal mass, of substantially equal transverse cross-sectional diameter perpendicular to longitudinal axis L of stimulation tool 10, and of substantially equal length, taken along longitudinal axis L. Component propellant grain 18*c*2 within propellant housing segment 14*a* and component propellant grain 18*c*2 within propellant housing segment 14*b* are each disposed immediately longitudinally outward from component propellant grains 18*a*2 within the respective housing segments 14*a* and 14*b*, and are the same propellant, of substantially equal mass, of substantially equal transverse cross-sectional diameter perpendicular to longitudinal axis L of stimulation tool 10, and of substantially equal length, taken along longitudinal axis L. An additional component propellant grain 18*b*2 of each multi-component propellant grain 18 is located in the fashion previously described within respective propellant housing sections 14*a* and 14*b*. Additional propellant grains 18*a*, 18*b* and 18*c* may be added sequentially to comprise a multi-component propellant grain to provide, upon combustion, an elevated pressure pulse exhibiting a ballistic trace of selected duration as well as pressure variability to selected levels for selected time intervals.

A propellant of each of the propellant grains 18*a*, 18*b*, 18*c*, etc., suitable for use in stimulation tool 10 may include, without limitation, a material used as a solid rocket motor propellant. Various examples of such propellants and components thereof are described in Thakre et al., *Solid Propellants*, Rocket Propulsion, Volume 2, Encyclopedia of Aerospace Engineering, John Wiley & Sons, Ltd. 2010, the disclosure of which document is incorporated herein in its entirety by reference. The propellant may be a class 4.1, 1.4 or 1.3 material, as defined by the United States Department of Transportation shipping classification, so that transportation restrictions are minimized. By way of example, the propellant may include a polymer having at least one of a fuel and an oxidizer incorporated therein. The polymer may be an energetic polymer or a non-energetic polymer, such as glycidyl nitrate (GLYN), nitratomethylmethyloxetane (NMMO), glycidyl azide (GAP), diethyleneglycol triethyleneglycol nitraminodiacetic acid terpolymer (9DT-NIDA), bis(azidomethyl)-oxetane (BAMO), azidomethylmethyl-oxetane (AMMO), nitraminomethyl methyloxetane (NAMMO), bis(difluoroaminomethyl)oxetane (BFMO), difluoroaminomethylmethyloxetane (DFMO), copolymers thereof, cellulose acetate, cellulose acetate butyrate (CAB), nitrocellulose, polyamide (nylon), polyester, polyethylene, polypropylene, polystyrene, polycarbonate, a polyacrylate, a wax, a hydroxyl-terminated polybutadiene (HTPB), a hydroxyl-terminated poly-ether (HTPE), carboxyl-terminated polybutadiene (CTPB) and carboxyl-terminated polyether (CTPE), diaminoazoxy furazan (DAAF), 2,6-bis (picrylamino)-3,5-dinitropyridine (PYX), a polybutadiene acrylonitrile/acrylic acid copolymer binder (PBAN), polyvinyl chloride (PVC), ethylmethacrylate, acrylonitrile-butadiene-styrene (ABS), a fluoropolymer, polyvinyl alcohol (PVA), or combinations thereof. The polymer may function as a binder, within which the at least one of the fuel and oxidizer is dispersed. In one embodiment, the polymer is polyvinyl chloride.

The fuel may be a metal, such as aluminum, nickel, magnesium, silicon, boron, beryllium, zirconium, hafnium, zinc, tungsten, molybdenum, copper, or titanium, or alloys mixtures or compounds thereof, such as aluminum hydride ($AlH_3$), magnesium hydride ($MgH_2$), or borane compounds ($BH_3$). The metal may be used in powder form. In one embodiment, the metal is aluminum. The oxidizer may be an inorganic perchlorate, such as ammonium perchlorate or potassium perchlorate, or an inorganic nitrate, such as ammonium nitrate or potassium nitrate. Other oxidizers may also be used, such as hydroxylammonium nitrate (HAN), ammonium dinitramide (ADN), hydrazinium nitroformate, a nitramine, such as cyclotetramethylene tetranitramine (HMX), cyclotrimethylene trinitramine (RDX), 2,4,6,8,10,12-hexanitro-2,4,6,8,10,12-hexaazaisowurtzitane (CL-20 or HNIW), and/or 4,10-dinitro-2,6,8,12-tetraoxa-4,10-diazatetracyclo-[$5.5.0.0^{5,9}.0^{3,11}$]-dodecane (TEX). In one embodiment, the oxidizer is ammonium perchlorate. The propellant may include additional components, such as at least one of a plasticizer, a bonding agent, a burn rate modifier, a ballistic modifier, a cure catalyst, an antioxidant, and a pot life extender, depending on the desired properties of the propellant. These additional components are well known in the rocket motor art and, therefore, are not described in detail herein. The components of the propellant may be combined by conventional techniques, which are not described in detail herein.

Propellants for implementation of embodiments of stimulation tool 10 may be selected to exhibit, for example, burn rates from about 0.1 in/sec to about 4.0 in/sec at 1,000 psi at an ambient temperature of about 70° F. Burn rates will vary, as known to those of ordinary skill in the art, with variance from the above pressure and temperature conditions before and during propellant burn.

Propellant grains 18*a*, 18*b*, 18*c*, etc., may be cast, extruded or machined from the propellant formulation. Casting, extrusion and machining of propellant formulations are each well known in the art and, therefore, are not described in detail herein. Each propellant formulation may be produced by conventional techniques and then arranged into a desired configuration within a propellant housing segment 14*a*, 14*b*. When, for example, two or more different propellants are used to form, for example, first and second component propellant grains 18*a* and 18*b* of a multi-component propellant grain 18, each propellant grain may be a homogeneous composition. For instance, each of a first propellant grain and a second propellant grain may be produced, for example, by casting or extrusion as elongated grains in a cylindrical configuration and each of the first and second propellant grains of appropriate length may be severed from its respective elongated cylindrical grain and assembled within respective housing sections 14*a* and 14*b*. Alternatively, each propellant grain may be cast or extruded initially to its final length for assembly into multi-component propellant grain 18.

The formulation of the propellants may be selected based on a desired pressure pulse ballistic trace upon initiation, which is determined by the target geologic strata within which the stimulation tool 10 is to be used. In accordance with the disclosure, each multi-component propellant grain 18 may include two or more different propellant grains 18*a*, 18*b*, etc., that produce the desired ballistic trace upon ignition. The multi-component propellant grain 18 may be configured, and initiated at a selected location on a surface thereof to produce, for example, a neutral burn. A neutral burn occurs when the reacting surface area of a propellant grain (in embodiments of the disclosure, a substantially constant transverse cross-sectional area) remains substantially constant over time as, for example, a propellant volume of substantially constant lateral extent (e.g., diameter) is initiated from an end surface.

Propellant grains 18 may be initiated through conventional techniques, for example, through initiation elements 20 comprising semiconductor bridge (SCB) initiators, which are lightweight, of small volume, and have low energy requirements (for example, less than 5 mJ), for actuation. Initiation elements 20 may be placed adjacent, or into, faces of component propellant grains 18*a*1. Examples of SCB initiators are described in U.S. Pat. Nos. 5,230,287 and 5,431,101 to Arrell et al., the disclosure of each of which is hereby incorporated herein in its entirety by this reference. It is also contemplated that other types of initiators, for example, electro-chemical initiators such as NASA Standard Initiator (NSI) initiators, and Low-Energy Exploding Foil (LEEFI) initiators, may be included. These and other components for propellant initiation are well known to those of ordinary skill in the art and, so, are not further described herein. Stimulation tool 10 may be deployed from the surface of the earth into a wellbore adjacent one or more producing formations by conventional apparatus 22, including without limitation wireline, tubing and coiled tubing connected by a signal conductor to firing head 24, from which initiation signals in the form of electrical pulses may be routed to initiation elements 20 through conductors, as is conventional. As another initiation alternative, a pressure-actuated firing head 24' may be employed to trigger initiation elements 20, through selective elevation of wellbore pressure, as known to those of ordinary skill in the art. In such a case, a simple slickline or unwired tubing may be used to deploy stimulation tool 10.

In use and when stimulation tool is deployed in a wellbore adjacent a producing formation, when initiation element 20 is triggered to ignite multi-component propellant grains 18, combustion products in the form of high pressure gases 26 (see FIG. 2) are generated and exit housing 12 through vent apertures 16*v* and are employed to stimulate the subterranean formation adjacent to stimulation tool 10. Formation stimulation may take the form, as noted previously, of fracturing the target rock formation. In embodiments of the present disclosure, component propellant types, configurations, amounts and burn rates may be adjusted to accommodate different geological conditions and provide different pressures and different pressure rise rates for maximum benefit. It is contemplated that fracturing may be effected uniformly (e.g., 360° about a wellbore axis), or directionally, such as, for example, in a 45° arc, a 90° arc, etc., transverse to the axis of the wellbore. Known technologies of propellant-based stimulation typically create fractures from about ten feet to about one hundred feet from the wellbore. Embodiments of propellant-based stimulation tools as described herein, by way of contrast, are expected to substantially extend fracture length well beyond capabilities of the current state of the art by providing a substantially longer duration for the stimulation event than can be provided by conventional propellant-based stimulation tools, as well as providing an ability to tailor the shape of the ballistic trace of the pressure pulse over the longer duration to optimize the pulse and more effectively fracture the rock formation in the vicinity of the wellbore. Embodiments of the disclosure are contemplated for use in restimulation of existing wells, in conjunction with hydraulic fracturing to reduce formation breakdown pressures, and as a substitute for conventional hydraulic fracturing.

The multi-component propellant grain 18 may, optionally, include a coating to prevent leaching of the propellant into the downhole environment during use and operation. The coating may include a fluoroelastomer, mica, and graphite, as described in the aforementioned, incorporated by reference U.S. Pat. Nos. 7,565,930, 7,950,457 and 8,186,435 to Seekford et al.

The disclosed propellant structures and combinations thereof may be used to provide virtually infinite flexibility to tailor a rise time, duration and magnitude of a pressure pulse, and time-sequenced portions thereof from propellant burn within the downhole environment to match the particular requirements for at least one of fracturing, perforating, and cleaning of the target geologic strata in the form of a producing formation for maximum efficacy. Propellant burn rates and associated characteristics (i.e., pressure pulse rise time, burn temperature, etc.) of known propellants and composite propellant structures, for example and without limitation, propellant structures comprising propellants employed in solid rocket motors for propulsion of aerospace vehicles and as identified above, in addition to conventional propellants employed in the oil service industry, may be mathematically modeled in conjunction with an initial burn initiation location to optimize magnitude and timing of gas pressure pulses from propellant burn.

Mathematical modeling may be based upon ballistics codes for solid rocket motors but adapted for physics (i.e., pressure and temperature conditions) experienced downhole, as well as for the presence of multiple apertures for gas from combusting propellant to exit a housing. The ballistics codes may be extrapolated with a substantially time-driven burn rate. Of course, the codes may be further refined over time by correlation to multiple iterations of empirical data obtained in physical testing under simulated downhole environments and actual downhole operations. Such modeling has been conducted with regard to conventional downhole propellants in academia and industry as employed in conventional configurations. An example of software for such modeling includes PULSFRAC® software developed by John F. Schatz Research & Consulting, Inc. of Del Mar, Calif., and now owned by Baker Hughes Incorporated of Houston, Tex. and licensed to others in the oil service industry. However, the ability to tailor and control extended propellant burn characteristics as enabled by embodiments of the present disclosure and ballistic trace signatures of extended duration and complexity has not been recognized or implemented by others of ordinary skill in the art.

Propellants as disclosed herein provide significant advantages over the use of hydraulic or explosive energy in fracturing. For example, conventional explosives may generate excessive pressure in an uncontrolled manner in a brief period of time (i.e., 1,000,000 psi in 1 microsecond), while hydraulic fracturing may generate much lower pressures over a long period of time (i.e., 5,000 psi in one hour). Propellant-base stimulation tools to be employed with pressure containment structures according to embodiments of the present disclosure may be used to generate relatively high, yet variable pressures in a relatively complex pattern over an extended time interval, for example, in variable pressures ranging upward to, for example, about 25,000 psi to about 50,000 psi, desirable pressure depending in part upon configuration of the well, and to prolong and vary such pressures in the form of a controlled ballistic trace for an extended time interval of, for example and without limitation, one to sixty seconds.

Multi-component propellant grains 18 as employed in an example stimulation tool 10 require physical containment of propellant-generated pressure in a wellbore to a specific interval comprising one or more producing zones to avoid dissipation of the generated pressure due to displacement of wellbore fluids, an issue which need not be addressed in pressure pulses of minimal duration, for example, less than one second wherein hydrostatic pressure and associated inertia of in situ wellbore fluids is sufficient to effectively contain the pressure pulse.

While, as noted above, it is known to employ pressure containment structures in the context of stimulation operations, some such structures are operable in response to displacement of wellbore fluid when elevated pressure is being generated and are not sufficiently robust to withstand some levels of elevated pressures for an extended period of time. Other known pressure containment structures are not configured to completely prevent displacement of wellbore fluid when elevated pressure is being generated. Still other known pressure containment structures require setting mechanisms and techniques independent of apparatus for generating or transmitting elevated pressure to a desired wellbore interval, or which cannot be positively initiated under all wellbore conditions and orientations (e.g., horizontal and other non-vertical wellbore intervals) to ensure pressure containment within the interval. In contrast, the stimulation tool of FIG. 1 includes one or more pressure containment structures in the form of packers 50 configured to set, expanding radially, responsive to pressure of gas generated through combustion of at least one propellant grain, for example, a first propellant grain 18*a* initiated, of multi-component propellant grain 18. Packers 50 may be configured to surround housing 12 and when expanded, seal radially between housing 12 and casing or liner within a wellbore, or the wellbore wall, or packers 50 may be secured to one or both ends of housing 12 and seal above and below housing 12.

Figure 2:
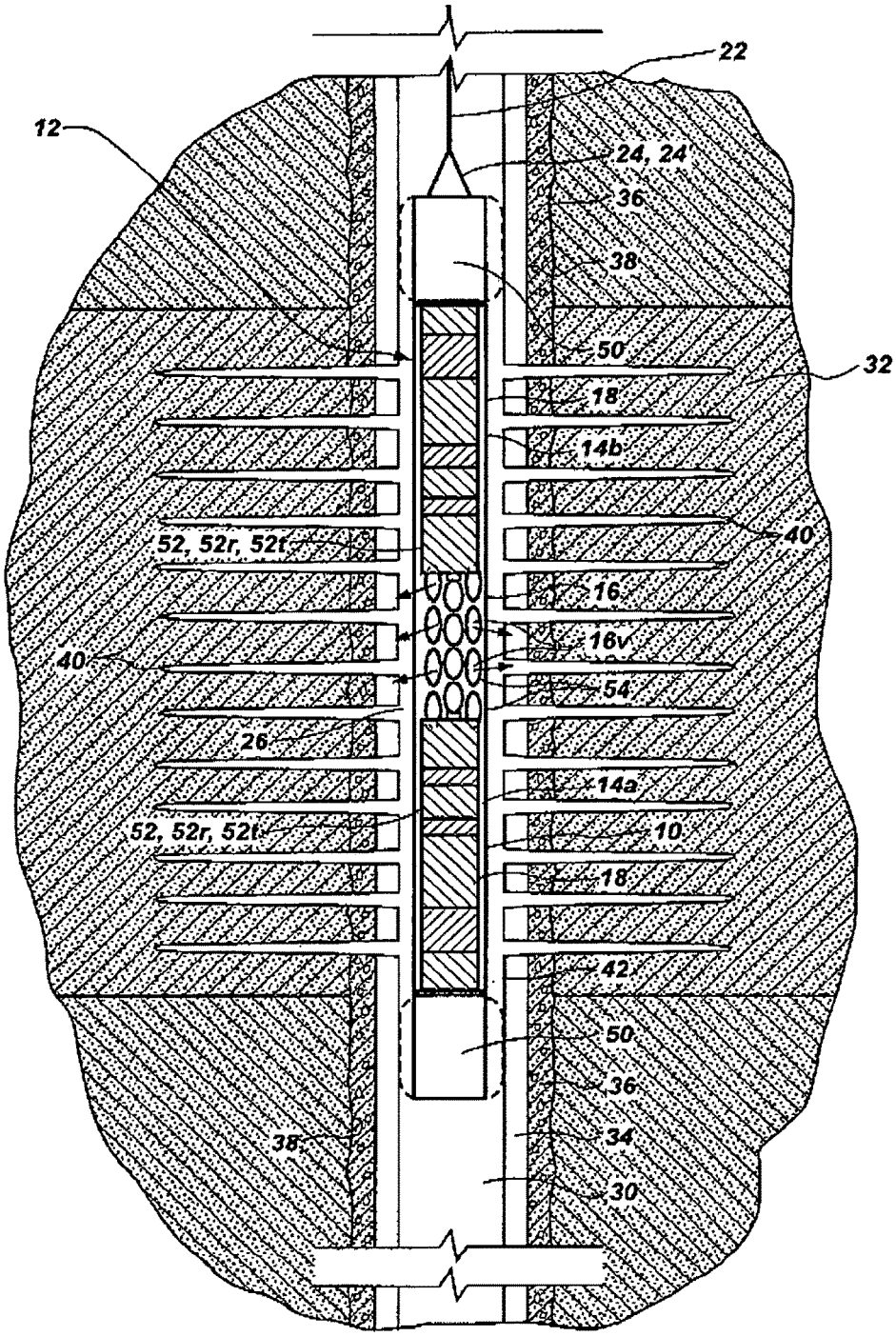
FIG. 2 is a schematic illustration of a pressure containment structure of the present disclosure as implemented with a propellant based stimulation tool, deployed in a wellbore.

In a first embodiment of a propellant-based stimulation tool, a stimulation tool 10 as depicted in and described with respect to FIG. 1 of the drawings, is shown in FIG. 2 deployed in a subterranean wellbore 30 intersecting a producing formation 32. While depicted as a vertical wellbore in FIG. 2, the disclosure is not so limited, and the wellbore 30 and intersecting producing formation 32 may each be at any angle to the vertical. Further, the wellbore may have tubular casing or liner as depicted at 34, cemented at least above and below producing formation as depicted at 36 between the wall 38 of wellbore and casing or liner 34, or may be unlined, depending upon the design of the stimulation operation. If casing or liner is present, conventionally such tubulars and the cement behind the tubular wall may be perforated as depicted at 40, which perforation may be conducted using shaped charges carried by a so-called "perforating gun" in the same or a different bottomhole assembly as stimulation tool 10. Stimulation tool 10 is equipped, according to this embodiment, with physical containment structures in the form of one or more packers 50 secured to stimulation tool 10 at each end thereof. A packer 50 may be located only proximate an upper end of stimulation tool, at both ends of stimulation tool 10, or a packer 50 may be located at an upper end of stimulation tool 10 and a bridge plug located at a lower end thereof, the term "packer," as used herein, including bridge plugs and other pressure containment structures. Packers and bridge plugs may each include anchor structure, such as slips, to secure a set packer or bridge plug against movement within a wellbore.

Packers 50 are activated to set against casing or liner 34 (in the example depicted) and seal wellbore interval 42 as shown at positions above and, optionally, below producing formation 32 by initiation of multi-component propellant grains 18 as described with respect to FIG. 1. More specifically, pressurized gas generated by combustion of propellant grains 18 longitudinally bypasses multi-component propellant grains 18 and 18 between the inner walls of propellant housing segments 14*a* and 14*b* of housing 12 in longitudinal directions away from vent section 16 to activate, or "set," packers 50 by expanding radially and sealing against casing or liner 34, or the wall 38 of wellbore 30, when the wellbore 30 is uncased and unlined. Such pressurized gas may bypass multi-component propellant grains 18 through longitudinal channels 52 between multi-component propellant grains 18 and an interior of propellant housing segments 14*a* and 14*b*, which channels 52 may merely comprise longitudinally extending recesses 52*r* in the exteriors of multi-component propellant grains 18 and 18, or may comprise tubular structures 52*t*. As another approach to provide a pressurized gas bypass, multi-component propellant grains 18 and 18 may be suspended within propellant housing segments 14*a* and 14*b* by so-called "spiders" disposed circumferentially about multi-component propellant grains 18 at longitudinal intervals and having apertures extending longitudinally therethrough, forming a substantially annular recess between. It may, optionally, be desirable to occlude vent apertures 16*v* of center vent section 16 with pressure release elements in the of burst discs, plugs or frangible elements 54 structured to fail or be expelled from vent apertures at a selected pressure above anticipated ambient hydrostatic wellbore pressure to cause one or more packers 50 to set before wellbore pressure is elevated within interval 42 through vent apertures 16*v*.

Figure 3A:
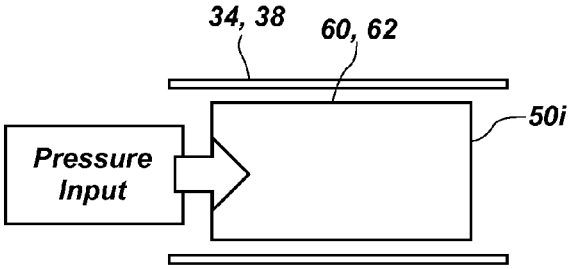
FIGS. 3A through 3C are schematic illustrations of an embodiment of a pressure containment structure of the present disclosure as implemented with a propellant based stimulation tool.
Figure 3B:
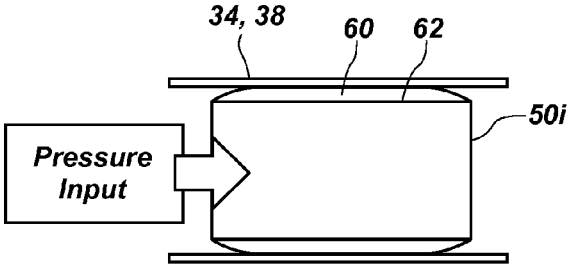
Figure 3C:
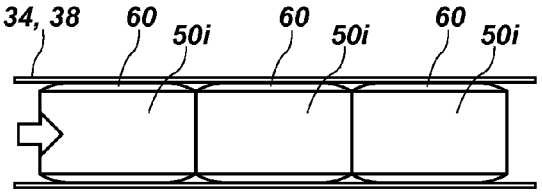

As shown in FIG. 3A, packers 50 in one embodiment may comprise inflatable packers 50*i*, wherein seal elements 60 in the form of radially expandable bladders are secured about mandrels 62 and are formed of a material, such as metal, having an elasticity sufficient to expand radially as shown in FIG. 3B under internal pressure of gases generated by combustion of propellant communicated through channels 52, and seal without substantial plastic deformation, so as to ensure retraction of the bladder elements 60 to substantially an initial, pre-expansion diameter upon normalization of wellbore pressure within interval 42 to hydrostatic post-stimulation, permitting withdrawal of stimulation tool 10 from the wellbore 30. Other elastic bladder materials known to those of ordinary skill in the art and suitable for maintaining structural integrity upon exposure to anticipated wellbore fluid and stimulation parameters (e.g., temperature, pressure, carbon dioxide, hydrogen sulfide, etc.) may also be employed, such materials having sufficient elasticity to collapse from an expanded state responsive to normalization of wellbore pressure within interval 42 with hydrostatic pressure outside interval 42. As shown in FIG. 3C, multiple adjacent inflatable packers 50*i* may be deployed in series, to ensure seal integrity. Inflatable packers 50*i* may be particularly suitable for, but not limited to, deployment in uncased, unlined wellbores.

Figure 4A:
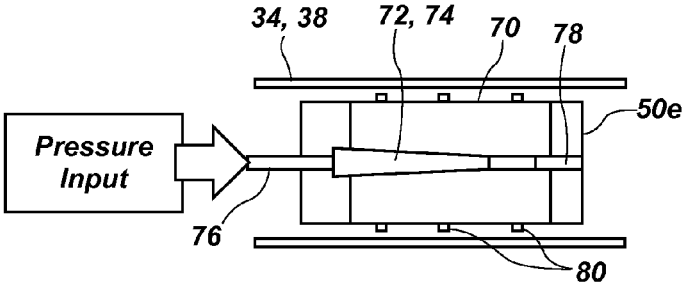
FIGS. 4A and 4B are schematic illustrations of another embodiment of a pressure containment structure of the present disclosure as implemented with a propellant based stimulation tool.
Figure 4B:
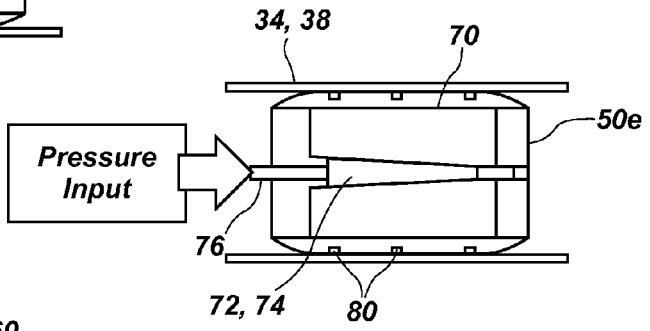

As shown in FIG. 4A, packers 50 in another embodiment may comprise expandable packers 50*e*, comprising one or more seal elements 70 comprising a compressible material carried on a mandrel 72, mandrel 72 comprising frustoconical wedge element 74 driveable by piston element 76 in communication with one or more channels 52. Packer seal elements 70, may comprise, for example and without limitation, an elastomer or other compressible material known to those of ordinary skill in the art configured annularly or of frustoconical shape and suitable for maintaining structural integrity upon exposure to anticipated wellbore fluid and stimulation parameters (e.g., temperature, pressure, carbon dioxide, hydrogen sulfide, etc.). Pressurized gas moves mandrel 72 longitudinally, expanding packer seal elements 70 radially to effect a seal against casing, liner or wellbore wall as shown in FIG. 4B. This particular embodiment may be suitable for, but not limited to, deployment in a cased or lined wellbore. Retraction of mandrel 72 and thus of wedge element 74 may be effected by spring 78, which may comprise, for example, a coil or Belleville spring compressed longitudinally by mandrel movement during packer expansion and which, upon normalization of wellbore pressure within interval 42 with hydrostatic pressure after stimulation, will return mandrel 72 to its initial longitudinal position. Additionally, circumferential spring elements 80 may be disposed about packer seal elements 70 to ensure radial retraction of packer seal elements 70.

It is also contemplated that multiple adjacent expandable packers 50*e* may be employed in series, and that a combination of inflatable packers 50*i* and expandable packers 50*e* may be employed in series.

Figure 5:
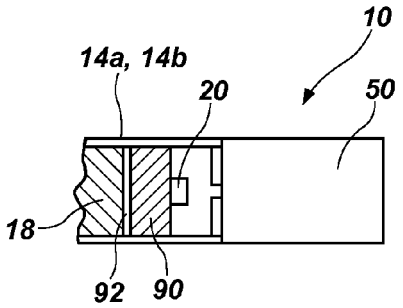
FIG. 5 is a schematic illustration of a further embodiment of a pressure containment structure of the present disclosure as implemented with a propellant based stimulation tool.

As shown in FIG. 5, in a further embodiment, packers 50 may be activated by initiation and combustion of a propellant grain 90 at an adjacent longitudinal end of a stimulation tool 10, combustion of such adjacent propellant grain 90 at a longitudinally outboard end of a multi-component propellant grain 18, separated therefrom by bulkhead 92 and activated by an initiation element 20 placed on or in the face of propellant grain 90. Initiation element 20 may be activated, for example, by a signal conveyed through a wireline or other conductor prior to an activation signal for initiation elements 20 for propellant grains 18*a* and 18*b*, to obtain packer setting before stimulation is initiated. Alternatively, firing head 24, 24' (FIGS. 1 and 2) may comprise a microprocessor programmed to sequentially activate initiation element 20 adjacent propellant grain 90 prior to activation of initiation elements 20 for multi-component propellant grains 18 and 18 responsive to a single signal.

While particular embodiments of the disclosure have been shown and described, numerous variations, modifications and alternative embodiments encompassed by the present disclosure will occur to those skilled in the art. Accordingly, the invention is only limited in scope by the appended claims and their legal equivalents.

What is claimed is:

1. A downhole stimulation tool, comprising:

a housing;

propellant structures within the housing and each individually comprising a heterogeneous stack of propellant regions configured and positioned to burn in sequence with one another upon ignition of the propellant structures, the propellant regions each individually comprising:

at least one propellant grain extending across at least a majority of a lateral cross-sectional area of the housing and having a first chemical composition; and at least one other propellant grain longitudinally adjacent the at least one propellant grain and extending across at least a majority of the lateral cross-sectional area of the housing, the at least one other propellant grain having a second chemical composition different than the first chemical composition;

at least one initiation element proximate one or more of the at least one propellant grain and the at least one other propellant grain of each of the propellant structures; and at least one pressure containment structure secured to the housing and comprising a seal element expandable in response to gas pressure generated by combustion of at least one of the propellant structures.

2. The downhole stimulation tool of claim 1, wherein:

the at least one propellant grain of each of the propellant structures comprises a plurality of propellant grains having the first chemical composition; and the at least one other propellant grain of each of the propellant structures comprises another plurality of propellant grains having the second chemical composition.

3. The downhole stimulation tool of claim 1, wherein:

the housing comprises:

a first propellant housing segment containing a first of the propellant structures;

a second propellant housing segment containing a second of the propellant structures; and a vent segment longitudinally intervening between an end of the first propellant housing segment and an end of the second propellant housing segment and comprising vent apertures through a wall thereof; and the at least one pressure containment structure comprises at least one radially expandable structure configured to expand responsive to gas pressure generated by combustion of one or more of an end of the first of the propellant structures proximate the vent segment of the housing and an end of the second of the propellant structures proximate the vent segment of the housing.

4. The downhole stimulation tool of claim 3, further comprising:

a first longitudinal channel between the first propellant housing segment and the first of the propellant structures contained therein prior to ignition of the first of the propellant structures, the first longitudinal channel in operable communication with the at least one pressure containment structure; and a second longitudinal channel between the second propellant housing segment and the second of the propellant structures contained therein prior to ignition of the first of the propellant structures, the second longitudinal channel in operable communication with the at least one pressure containment structure.

5. The downhole stimulation tool of claim 4, wherein the at least one pressure containment structure comprises:

a first pressure containment structure in operable communication with the first longitudinal channel and secured to another end of the first propellant housing segment distal from the vent segment; and a second pressure containment structure in operable communication with the second longitudinal channel and secured to another end of the second propellant housing segment distal from the vent segment.

6. The downhole stimulation tool of claim 4, wherein the first longitudinal channel is selected from the group consisting of:

a longitudinal recess in an exterior surface of the first of the propellant structures;

a tubular structure; and a substantially annular recess between the first of the propellant structures and an interior surface of the first propellant housing segment.

7. The downhole stimulation tool of claim 3, wherein at least a majority of the vent section of the housing is substantially free of propellant contained therein prior to ignition of the propellant structures.

8. The downhole stimulation tool of claim 1, further comprising:

a first longitudinal channel intervening between the housing and a first of the propellant structures, the first longitudinal channel in operable communication with the at least one pressure containment structure and located laterally adjacent the at least one initiation element of the first of the propellant structures; and a second longitudinal channel intervening between the housing and a second of the propellant structures, the second longitudinal channel in operable communication with the at least one pressure containment structure and located laterally adjacent the at least one initiation element of the second of the propellant structures.

9. The downhole stimulation tool of claim 8, wherein:

the first longitudinal channel is selected from the group consisting of:

a first longitudinal recess in an exterior surface of the first of the propellant structures prior to ignition of the first of the propellant structures; and a first substantially annular recess between the first of the propellant structures and an interior surface of the housing prior to ignition of the first of the propellant structures; and the second longitudinal channel is selected from the group consisting of:

a second longitudinal recess in an exterior surface of the second of the propellant structures prior to ignition of the second of the propellant structures; and a second substantially annular recess between the second of the propellant structures and the interior surface of the housing prior to ignition of the second of the propellant structures.

10. The downhole stimulation tool of claim 1, wherein the seal element of the at least one pressure containment structure comprises an inflatable bladder.

11. The downhole stimulation tool of claim 1, wherein the seal element of the at least one pressure containment structure comprises a compressible material.

12. The downhole stimulation tool of claim 1, wherein the at least one pressure containment structure comprises a series of longitudinally adjacent pressure containment structures.

13. The downhole stimulation tool of claim 1, wherein the at least one initiation element of each of the propellant structures comprises at least one of a semiconductor bridge (SCB) initiator, a NASA Standard Initiator (NSI), and a Low-Energy Exploding Foil Initiator (LEEFI).

14. The downhole stimulation tool of claim 1, wherein the housing comprises a vent segment comprising:

vent apertures through a wall thereof; and pressure release elements occluding the vent apertures and operably configured to open the vent apertures at a pressure above anticipated hydrostatic wellbore pressure of a wellbore into which the stimulation tool is to be deployed.

15. A method of operating a downhole stimulation tool, the method comprising:

deploying the downhole stimulation tool within a wellbore adjacent a producing formation, the downhole stimulation tool comprising:

a housing;

propellant structures within the housing and each individually comprising a heterogeneous stack of propellant regions configured and positioned to burn in sequence with one another upon ignition of the propellant structures, the propellant regions each individually comprising:

at least one propellant grain extending across at least a majority of a lateral cross-sectional area of the housing and having a first chemical composition; and at least one other propellant grain longitudinally adjacent the at least one propellant grain and extending across at least a majority of the lateral cross-sectional area of the housing, the at least one other propellant grain having a second chemical composition different than the first chemical composition;

at least one initiation element proximate one or more of the at least one propellant grain and the at least one other propellant grain of each of the propellant structures; and at least one pressure containment structure secured to the housing and comprising a seal element expandable in response to gas pressure generated by combustion of at least one of the propellant structures;

initiating the propellant structures from faces thereof to burn the at least one propellant grain and the at least one other propellant grain of each of the propellant structures in a longitudinally extending direction and generate gas pressure for stimulating the producing formation;

transmitting a portion of the gas pressure generated by combusting at least one of the propellant structures of the downhole stimulation tool to expand at least one seal element of at least one pressure containment structure secured to a housing of the downhole stimulation tool; and elevating pressure within the wellbore to stimulate the producing formation with a remaining portion of the generated gas pressure.

16. The method of claim 15, wherein transmitting a portion of the gas pressure generated by combusting at least one of the propellant structures of the downhole stimulation tool to expand at least one seal element of at least one pressure containment structure comprises transmitting the portion of the generated gas pressure to expand seal elements of each of two pressure containment structures located at opposing ends of the housing of the downhole stimulation tool.

17. The method of claim 16, further comprising venting a remaining portion of the generated gas pressure through vent apertures proximate a longitudinal center of the downhole stimulation tool.

18. The method of claim 15, further comprising venting a remaining portion of the generated gas pressure through vent apertures proximate a longitudinal center of the downhole stimulation tool.

19. The method of claim 15, further comprising opening vent apertures in a wall of the housing of the downhole stimulation tool responsive to gas pressure within the downhole stimulation tool above ambient hydrostatic wellbore pressure and subsequent to expansion of the at least one seal element of the at least one pressure containment structure.

20. The method of claim 15, wherein expanding the at least one seal element of the at least one pressure containment structure comprises one of inflating a bladder and compressing the at least one seal element.

21. The method of claim 15, further comprising permitting the at least one seal element of the at least one pressure containment structure to retract responsive to wellbore pressure normalizing with ambient hydrostatic wellbore pressure after stimulation of the producing formation.

* * * * *